United States Patent [19]

Gilbert et al.

[11] Patent Number: 4,973,433

[45] Date of Patent: Nov. 27, 1990

[54] APPARATUS FOR INJECTING GAS INTO MOLTEN METAL

[75] Inventors: Ronald E. Gilbert, Chardon; Harvey Martin, Solon; George S. Mordue, Ravenna, all of Ohio

[73] Assignee: The Carborundum Company, Niagara Falls, N.Y.

[21] Appl. No.: 387,168

[22] Filed: Jul. 28, 1989

[51] Int. Cl.[5] ..... B01F 3/04

[52] U.S. Cl. ..... 261/122

[58] Field of Search ..... 261/122

[56] References Cited

U.S. PATENT DOCUMENTS

| | | | |
|---|---|---|---|
| 2,294,973 | 9/1942 | Ford | 261/122 |
| 2,354,609 | 7/1944 | Phipps | 261/122 |
| 2,575,193 | 11/1951 | Shire | 261/122 |
| 2,774,585 | 12/1956 | Wirts | 261/122 |
| 3,330,645 | 7/1967 | Moustier et al. | 261/122 |
| 3,753,746 | 8/1973 | Koerner | 261/122 |
| 4,046,845 | 9/1977 | Veeder | 261/122 |

*Primary Examiner*—Tim Miles

*Attorney, Agent, or Firm*—Weston, Hurd, Fallon, Paisley & Howley

[57] ABSTRACT

Apparatus for injecting gas into molten metal includes a porous ceramic body having a first surface through which gas can be introduced into the body, and a second surface through which gas can flow from the body. A refractory member is attached to the body and surrounds at least the first surface, while leaving the second surface exposed. The refractory member is impervious to gas, while having a coefficient of thermal expansion approximating that of the body. Preferably, a refractory sealant securely attaches the refractory member to the body. By use of the present invention, the refractory member and the body remain tightly connected to each other at all times. Accordingly, gas leaks are prevented and all gas flowing into the body is discharged through the second surface, as desired.

29 Claims, 2 Drawing Sheets

APPARATUS FOR INJECTING GAS INTO MOLTEN METAL

BACKGROUND OF THE INVENTION

1. Field of the Invention.

The invention relates to apparatus for injecting gas into molten metal and, more particularly, to a technique for supporting a porous, ceramic, gas-dispersing body such that cracks, with attendant gas leakage, are eliminated.

2. Description of the Prior Art.

In the course of processing molten metals, it sometimes is necessary to treat the metals with gas. For example, it is customary to inject gases such as nitrogen, chlorine, and argon into molten aluminum and molten aluminum alloys in order to remove undesirable constituents such as hydrogen gas, non-metallic inclusions, and alkali metals. The gases added to the molten metal chemically react with the undesired constituents to convert them to a form (such as a precipitate, a dross, or an insoluble gas compound) that can be separated readily from the remainder of the molten metal.

As used herein, reference to "molten metal" will be understood to mean any metal such as aluminum, magnesium, copper, iron, and alloys thereof, which are amenable to gas purification. Further, the term "gas" will be understood to mean any gas or a combination of gases, including argon, nitrogen, chlorine, freon, sulfur hexafluoride, and the like, that have a purifying effect upon molten metals with which they are mixed. The process of introducing purifying gas into molten metal is referred to variously as "gas injection" or "degassing."

In order to efficiently carry out a gas injection operation, it is desirable that the gas be introduced into the molten metal in the form of a large number of extremely small bubbles. As the size of the gas bubbles decreases, the number of bubbles per unit volume increases, and thus the total surface area per unit volume increases. An increase in the number of bubbles and their surface area per unit volume increases the probability of the gas being utilized effectively to purify the molten metal.

One known technique for introducing gas into molten metal consists of lining a portion of a molten metal-containing vessel (preferably the bottom of the vessel) with a porous ceramic body. The gas is introduced into the body at a location remote from the metal-contacting surface of the body. During its passage through the body, the gas follows a number of small, tortuous paths such that a large number of small bubbles will be issued into the molten metal. Porous ceramic bodies have been used as described for the purification of molten metal, and are commercially available from North American Refractories Company (NARCO), Cleveland, Ohio 44115, under the trademarks A-94 and MAS-100.

In the referenced NARCO apparatus, the porous ceramic body is supported by a metal casing that acts as a manifold to introduce gas into the body. Typically, the casing is made of mild steel (for use with argon or nitrogen) or inconel (for use with chlorine or freon). The assembled body/casing is surrounded and supported by a nest brick comprised of a refractory material such as low-cement alumina castable. The nest brick includes an opening through which a surface of the body is exposed for the discharge of bubbles into molten metal. The assembled body, casing, and nest brick are supported within a molten metal container such as a furnace, ladle liner, ladle, or filter box, usually by being cast in place by means of a refractory material such as low-cement alumina castable.

A problem with the foregoing construction is that it is difficult to maintain an effective gas seal between the casing and the body, and between the casing and the nest brick. The difficulty arises in part because the coefficients of thermal expansion of the metal casing and the refractory materials are considerably different; also, the metal casing is subject to attack if chlorine is the gas being used. If a crack should develop (as used herein, the term "crack" refers to any defect in the gasdispersing apparatus that permits undesired gas leakage), gas will leak through the crack, and thereafter frequently will migrate through the nest brick and refractory support to the ambient atmosphere. Gas migration through 20 inches or more of refractory material is possible. The problem is particularly acute in the case of chlorine due to the harmful effects of chlorine upon release into the atmosphere. The problem also is undesirable if argon is being used due to the relatively great expense of argon. Regardless of the type of purifying gas being used, it is important that cracks be prevented so that gas leakage will be prevented.

Desirably, a technique would be available for injecting gas into molten metal that would accomplish the objectives of dispersing a large number of exceedingly small bubbles into the molten metal while, at the same time, avoiding cracks in the gas dispersing apparatus that result in gas leakage. It also would be desirable for any such apparatus to be capable of being manufactured easily, at reasonable expense. Further, it would be desirable that any such gas injection apparatus be usable with existing equipment such as ladles, furnaces, and the like, with no modification, or with only minor modification, of the existing equipment.

Summary of the Invention

The present invention overcomes the foregoing and other difficulties of the prior art by providing a new and improved apparatus for injecting gas into molten metal. In the preferred embodiment of the present invention, a porous ceramic body of spinel, silicon carbide, alumina, or other suitable porous ceramic material is provided. The body includes a first surface through which gas can be introduced into the body, and a second surface through which gas can be discharged from the body. A refractory member is provided that engages the body and surrounds the first surface. Preferably, the refractory member is made of graphite or other refractory material that is impervious or substantially impervious to gas and which has a coefficient of thermal expansion approximating that of the body. It also is preferred that the refractory member be connected to the body by means of a refractory sealant that both (1) attaches the refractory member to the body in a secure manner and (2) assists in preventing gas leakage.

In the preferred embodiment of the invention, a space is created between the refractory member and the first surface so as to define a plenum therebetween. The invention includes means for conveying gas into the plenum, which means preferably takes the form of a refractory conduit extending into an opening formed in the refractory member. Structural support can be provided for the refractory conduit, if desired. The structural support can take the form of a metal tube extending partially into the refractory member. The conduit projects from the end of the tube in order to extend further into the refractory member than the tube.

It is expected that the assembled body, refractory member, and gas conveying means will be cast in place within a refractory support comprised of a material such as low-cement alumina castable. The refractory support includes an opening through which the second surface of the body is exposed. The assembled body, refractory member, gas conveying means and refractory support can be cast in place within a ladle, furnace, and the like, by means of a castable refractory material such as low-cement alumina castable.

By use of the present invention, cracks are eliminated, or at least are greatly minimized. This result is believed to be brought about by the materials that comprise the body, the refractory member, and the refractory conduit. The body and the refractory member have similar coefficients of thermal expansion that serve to prevent the formation of cracks upon thermal cycling. Also, the materials used for the refractory member and the gas-conveying means are impervious to gas. Even should the gas condense, both the refractory member and the refractory conduit have unique corrosion resistance to condensed chlorine attack, unlike prior metal casings and gas-conveying conduits. Even if cracks should form for some reason, the particular technique used for conveying gas into the plenum provides a back-up seal that will tend to prevent gas from migrating to the atmosphere.

The foregoing, and other features and advantages of the invention, will be apparent from reviewing the description and claims that follow, together with the drawings.

Description of the Preferred Embodiment

Figure 1:
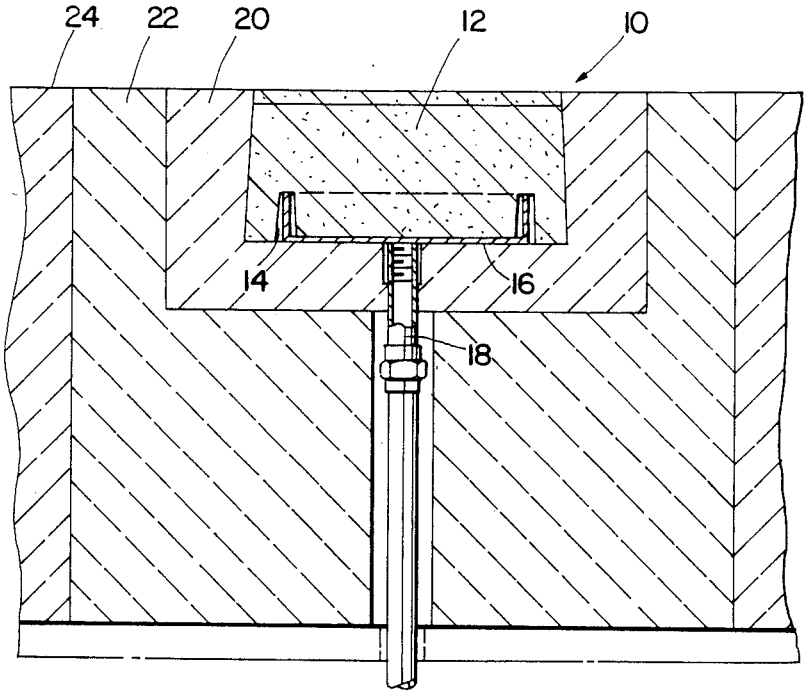
Fig. 1 PRIOR ART
FIG. 1 is a cross-sectional view of a typical prior art gas injection apparatus in which a porous ceramic body is connected to a metal casing.

Referring to FIG. 1, a typical gas injection apparatus according to the prior art is indicated by the reference numeral 10. The gas injection apparatus 10 includes a porous ceramic plug 12 having a groove 14 formed in the rear face thereof. A metal casing 16, formed of mild steel or inconel, is inserted into the groove 14 and is securely attached to the plug 12 by means of refractory cement. The casing 16 includes a gas inlet pipe 18.

The assembled plug 12 and casing 16 are disposed within a so-called nest brick 20 formed of a refractory material such as low-cement alumina castable. In turn, the nest brick 20 is cast in place within a refractory support 22 formed of a material such as low-cement alumina castable. The support 22 is disposed within high temperature insulation 24 that forms a portion of the existing lining of the ladle, furnace or other structure with which the gas injection apparatus 10 is to be used.

Although the apparatus 10 functions effectively to introduce a large number of small gas bubbles through the plug 12, a problem frequently develops as the device is used in practice. Specifically, the apparatus 10 is subject to thermal cycling as molten metal is added to, or removed from, the vessel with which the apparatus 10 is used. The plug 12 has a coefficient of thermal expansion ("CTE") considerably different than that of the casing 16. If the plug 12 is formed predominately of alumina, its CTE will be approximately $4.8\times10^{-6}$ inches per inch per ° F. On the other hand, if the casing 16 is made of steel, its CTE will be approximately $6.5\times10^{-6}$ inches per inch per ° F. at 212° F. If the casing 16 is made of inconel, than its CTE will be about $7.0\times10^{-6}$ inches per inch per F at 200° F., and about $8.8\times10-6$ inches per inch per ° F at 1400° F. Regardless of the metal that is used for the casing 16, it is subject to attack by the gas if the gas being used is chlorine.

It is believed that the large disparity in CTE between the plug 12 and the casing 16 eventually leads to cracks being formed upon thermal cycling of the apparatus 10. It is believed that cracks also may be formed if the casing 16 is attacked by the gas being used. These cracks permit gas being directed into the plug 12 to flow away from the plug 12 and through the joints connecting the plug 12 with the nest brick 20 and the gas inlet pipe 18. The leakage of gas is very detrimental, particularly in the case of chlorine due to its toxicity, and in the case of argon due to its expense. Regardless of the type of gas that may be leaking, such leakage is undesirable and renders the entire apparatus 10 unfit for further service. The apparatus 10 must be removed and replaced, obviously at considerable inconvenience and expense.

Figure 2:
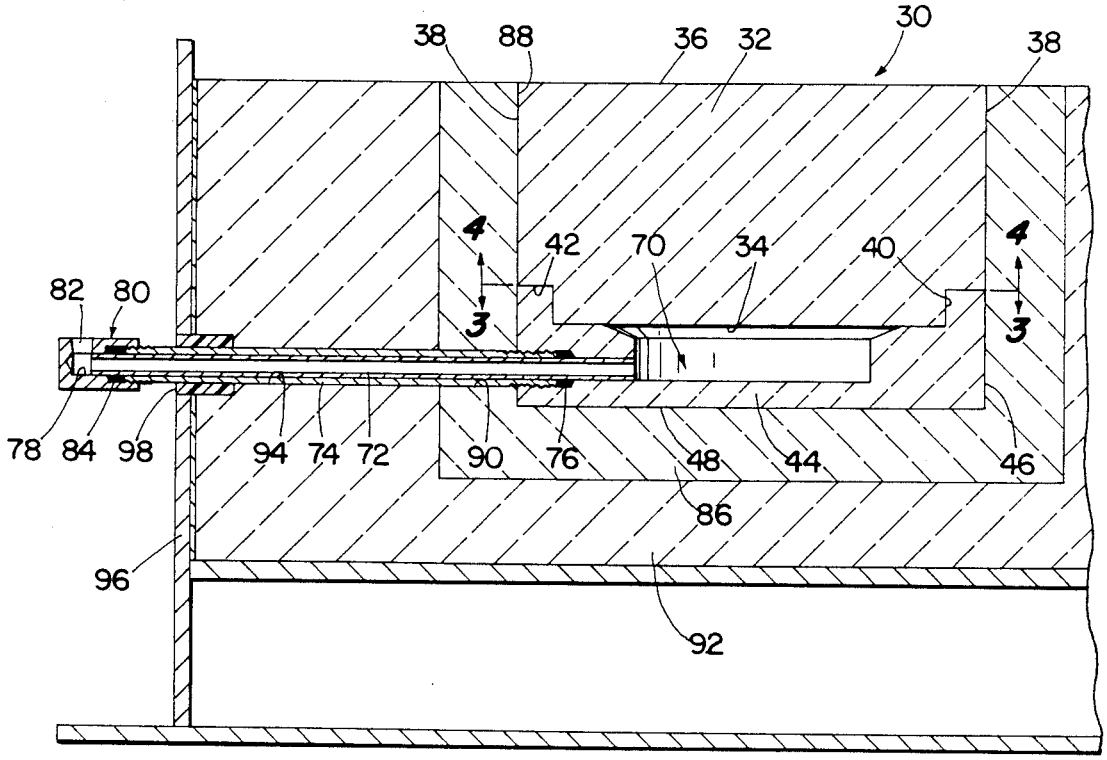
FIG. 2 is a cross-sectional view of gas injection apparatus according to the invention.
Figure 3:
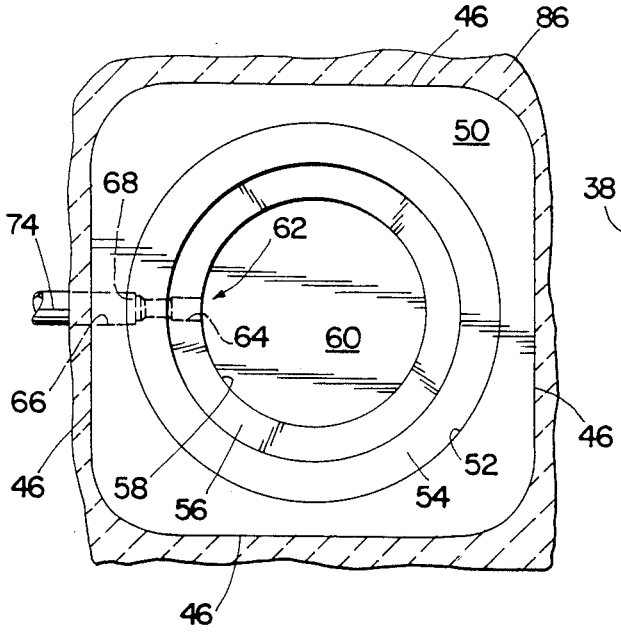
FIG. 3 is a cross-sectional view of the apparatus of FIG. 2, taken along a plane indicated by line 3—3 in FIG. 2.
Figure 4:
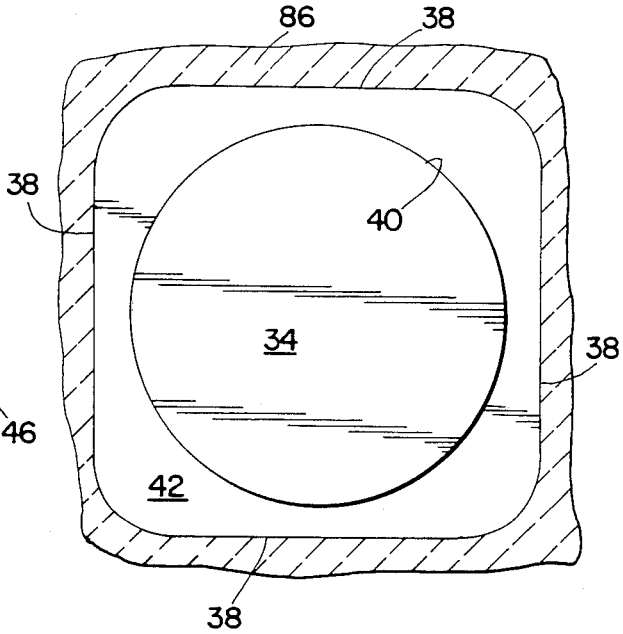
FIG. 4 is a cross-sectional view of the apparatus of FIG. 2, taken along a plane indicated by line 4—4 in FIG. 2.

Referring now to FIGS. 2-4, gas injection apparatus according to the invention is indicated by the reference numeral 30. The apparatus 30 includes a porous ceramic body 32 having a first surface 34 through which gas ca be directed into the body 32. The body 32 includes a second surface 36, spaced from the first surface 34, through which gas can be discharged from the body 32 into molten metal being treated. The greater portion of the body 32 is generally cubic with straight-sided sidewalls 38. The walls 38 are parallel with each other, as are the first and second surfaces 34, 36. The first surface 34 is smaller than the second surface due to a reduced-diameter shoulder 40. The shoulder 40 projects from a flat-sided ledge 42 that is parallel to the surfaces 34, 38.

It is expected that the body 32 will be formed of any suitable porous ceramic material commonly used for dispersing gas bubbles into molten metal. For example, the body 32 could be manufactured predominately of fused alumina or sintered spinel. Fused alumina ceramic bodies are commercially available from NARCO, Cleveland, Ohio 44115 under the trademark A-94. Sintered spinel ceramic bodies are available from NARCO under the trademark MAS-100.

The apparatus 10 also includes a refractory member 44 that engages the body 32 and which surrounds the first surface 34. Referring particularly to FIGS. 2 and 3, the member 44 includes straight-sided sidewalls 46, a flat bottom wall 48, an upper ledge 50, a vertically extending annular wall 52, a laterally extending ledge 54 that projects radially inwardly from the wall 52, a beveled surface 56 that projects radially inwardly from the ledge 54, a vertically extending annular wall 58 that extends downwardly from the beveled surface 56, and a flat inner floor 60. The member 44 also includes a gas inlet opening 62 defined by a bore 64 that opens through the wall 58 and through a selected one of the sidewalls 46. The bore 64 includes a threaded portion 66 that opens through the sidewall 46, and a tapered shoulder 68 that connects the bore 64 and the threaded portion 66. The relationship among the first surface 34, the beveled shoulder 56, the wall 58 and the floor 60 creates a volume, or plenum 70, between the facing portions of the body 32 and the refractory member 44.

As will be apparent from an examination of FIGS. 2 and 3, the ledges 42, 50 are in substantial surface-to-surface contact with each other, as are the vertically extending walls 40, 52. Also, the ledge 54 is in substantial surface-to-surface contact with the radially outermost portion of the first surface 34. In order to securely connect the body 32 and the refractory member 44 to each other, the ledges 42, 50 are joined by refractory cement such as that sold under the trademark FRAXSET, commercially available from the Metaullics Systems Division of The Carborundum Company, 31935 Aurora Road, Solon, Ohio 44139. In order to seal the body 32 and the member 44 against gas leakage, high temperature sealant is applied to the remaining surfaces of the body 32 and the member 44 that contact each other, that is, the sealant is applied to the walls 40, 52, to the ledge 54, and to that portion of the first surface 34 that contacts the ledge 54. The sealant also is applied to the beveled surface 56, the wall 58, and the floor 60. Suitable sealants includes DYLON cement, commercially available from the Dylon Company, Cleveland, Ohio, and P-33 cement, commercially available from The Union Carbide Company, Clarksburg, West Virginia.

The material chosen for the refractory member 44 can be any suitable refractory material that has a CTE approximating that of the body 32 and which is impervious or substantially impervious to gas. Suitable materials for the member 44 include graphite and silicon carbide. The CTE of graphite is about $2.54\times10^{-6}$ inches per inch per ° F. The CTE of of silicon carbide is about $2.2\times10^{-6}$ inches per inch per ° F. Graphite is preferred for degassing low temperature, non-ferrous material such as aluminum or zinc. The graphite preferably is treated with an anti-oxidation treatment such as SUPER NOX, commercially available from the Metaullics Systems Division of The Carborundum Company, 31935 Aurora Road, Solon, Ohio 44139. Suitable graphite is commercially available from the Great Lakes Carbon Corporation, Niagara Falls, New York, under the trademark HLM. Silicon carbide is preferred for high temperature, non-ferrous applications, and all ferrous applications. An acceptable grade of silicon carbide is sold under the trademark HEXOLOY by The Carborundum Company, Niagara Falls, New York 14301.

The apparatus 10 includes means for conveying gas through the refractory member 44 and into the body 3 through the first surface 34. The gas-conveying means includes an elongate refractory conduit 72, one end of which extends into the bore 64. Structural support for the conduit 72 is provided by a tube 74 within which the conduit 72 is disposed. The tube 74 is threaded at both ends. A packing 76 is disposed within the threaded portion 66 and is compressed in place against the beveled shoulder 68 by the end of the tube 74. The conduit 72 extends beyond the end of the tube 74 so as to extend further into the member 44 than the tube 74. The conduit 72 is secured in place within the bore 64 by means of refractory cement such as FRAXSET cement. Similarly, the threaded end of the tube 74 is secured within the threaded portion 66 by means of refractory cement such as FRAXSET cement.

The other end of the conduit 72 extends into a bore 78 formed in an elbow 80. An inlet opening 82 intersects the bore 78. The bore 78 includes a threaded portion that is adapted to receive the threaded end of the tube 74. A packing 84 is disposed within the threaded portion 84 for compression by the end of the tube 74 in the same manner that the packing 76 is compressed within the bore 64.

It is preferred that the conduit 72 be made from a refractory substance such as silicon carbide. A suitable silicon carbide material for the conduit 72 is manufactured under the trademark HEXOLOY by The Carborundum Company, Niagara Falls, New York 14301. HEXOLOY is a unique form of silicon carbide especially resistant to potential chlorine corrosion. The tube 74 can be metal, preferably inconel. The elbow 80 can be any inexpensive, readily available metal such as mild steel. The packings 76, 84 preferrably are made of graphite.

The body 32 and the member 44 are disposed within a refractory support 86. The support 86 is made of a refractory material such as low-cement alumina castable or graphite. The support 86 completely surrounds the body 32 and the member 44, except for an opening 88 through which the second surface 36 is exposed. As illustrated, the opening 88 and the second surface 36 are flush with each other. An opening 90 in the support 86 permits the conduit 72 and the tube 74 to extend through the side of the support 86.

The support 86 is surrounded by a second refractory support 92. The second support 92, like the first support 86, is made from a refractory material such as low-cement alumina castable or graphite. Alternatively, a composition consisting predominately of alumina (about 70% alumina) can be used. The support 92 includes an opening 94 that is aligned with the opening 90 in order to permit the tube 72 and the conduit 74 to extend through the side of the support 92.

The support 92 is held in place by a framework indicated at 96. The framework 96 is included as part of the ladle, furnace, or other structure with which the apparatus 30 is used. A pliable seal 98 disposed in the opening 94 surrounds the tube 7 at that point where the tube 74 extends through the framework 96. The seal 98 can be made of any low temperature, flexible sealant that remains flexible at temperatures of about 400° F. and below. One suitable sealant is sold under the trademark KROJACK by NARCO, Cleveland, Ohio 44115. In addition to the seal 98, the tube 74 is wrapped by several layers of insulating paper (not shown). Suitable insulating paper is commercially available from The Carborundum Company, Niagara Falls, New York 10431 under the trademark FIBERFRAX.

Assembly and Operation

The apparatus 30 is assembled and operated as follows:

1. After the body 32 and the member 44 have been manufactured, they are connected to each other by means of FRAXSET cement and a high-temperature sealant such as DYLON cement, as indicated previously.

2. The conduit 72 and the tube 74, together with the packing 76, are fitted into the bore 64 and permanently assembled there by means of FRAXSET cement.

3. The elbow 80 is connected to the other end of the conduit 72 and the tube 74, with the packing 84 being compressed in place within the bore 78. It is not necessary for any other sealed connection to be made between the elbow 80 and either the conduit 72 or the tube 74.

4. The tube 74 is wrapped with several layers of insulating paper.

5. The support 86 is cast in place about the assembled body 32, refractory member 44, and tube 74. The conduit 72 and tube 74, with elbow 80 attached, project laterally from the sidewall 46 and through the opening 90 in the support 86.

6. The support 86 is installed within the furnace, ladle, or other molten metal-handling vessel such that the elbow 80 projects through the framework 96.

7. The apparatus 30 is held in proper position relative to the framework 96 and a removable plug of the same size and shape as the seal 98 is installed about the tube 74.

8. The second refractory support 92 is cast in place about the paper-wrapped tube 74 and the support 86.

9. The plug is removed and the seal 98 is installed in its place.

10. After the foregoing operations have been completed, a suitable source of gas (not shown) can be connected to the inlet opening 82 and gas can be conveyed through the conduit 72, the plenum 70 and through the body 32 by way of the first surface 34.

An Alternative Embodiment

Figure 5:
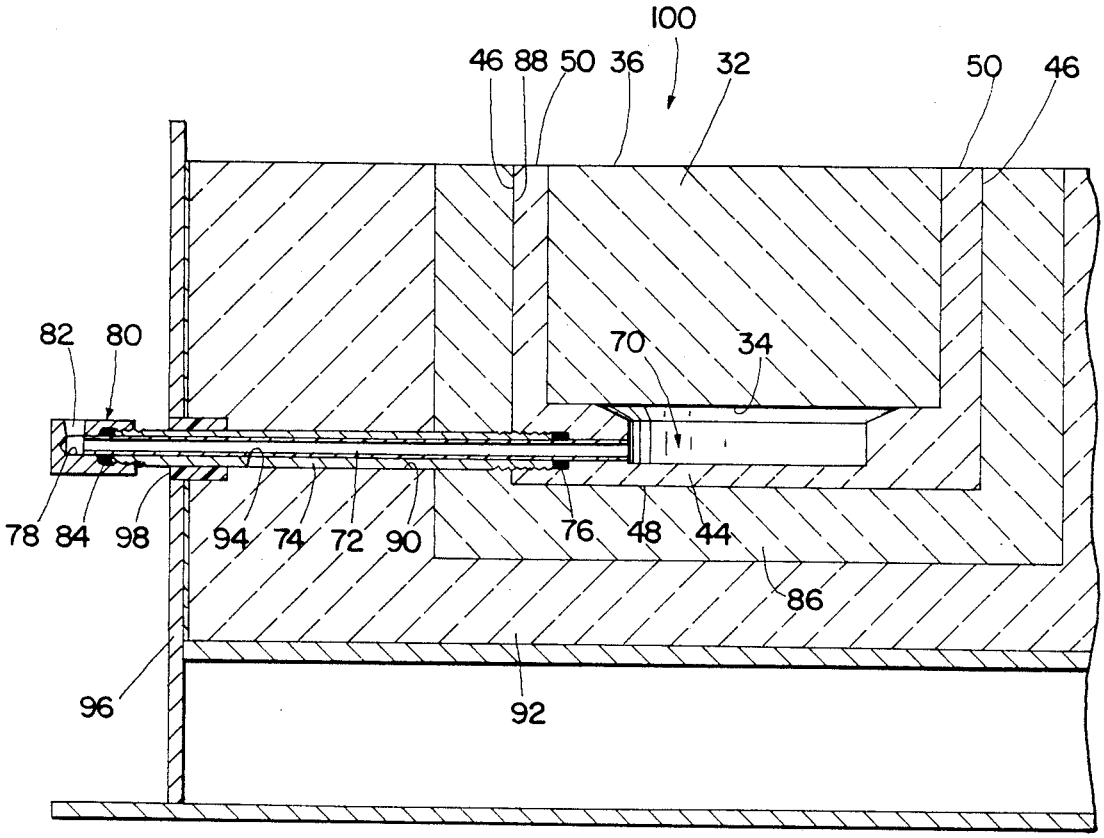
FIG. 5 is a cross-sectional view of an alternative embodiment of the invention.

Referring to FIG. 5, an alternative embodiment of the invention is indicated by the reference numeral 100. The embodiment illustrated in FIG. 5 is identical in all respects with the embodiment shown in FIGS. 2–4, except that the sidewalls 46 and the vertically extending walls 52 of the member 44 extend the length of the body 32. The ledge 50 is flush with the exposed second surface 36 and the exposed end of the refractory support 86. In the alternative embodiment, the refractory member 44, in effect, defines a casing within which the body 32 is completely exclosed except for the exposed second surface 36.

It is contemplated that additional alternative embodiments could be made wherein the ledge 50 terminates at different axial distances relative to the body 32. Design considerations related to the axial extent of the refractory member 44 include gas flow and gas leakage prevention. That is, the greater the volume occupied by the refractory member 44, the less volume occupied by the body 32 with a consequent decrease in gas flow capabilities. On the other hand, the more the body 32 is surrounded by the refractory member 44, the stronger the connection therebetween and the less the likelihood that gas can escape laterally from the body 32. If the refractory member 44 completely surrounds the body 32 (if the ledge 50 is exposed flush with the second surface 36), then the connection between the body 32 and the member 44 is more susceptible to attack by molten metal. Consequently, it is preferred that the refractory member 44 have an axial extent such as that illustrated in FIG. 2, or some axial extent less than that illustrated in FIG. 5.

As will be apparent from the foregoing description, the apparatus according to the invention is exceedingly effective in dispersing a large number of small bubbles into molten metal while, at the same time, avoiding cracks in the gas-dispersing apparatus that can lead to gas leakage. The various components used with the invention can be manufactured readily, and they can be assembled with a minimum of difficulty. It is expected that the invention will eliminate, or at least substantially eliminate, cracks such that premature replacement of the gas-dispersal apparatus will be avoided. In that connection, it is noted that the various cemented and sealed surfaces, together with the packing 76, provide a backup sealing capability in the event a crack inadvertently should develop in the member 44.

Although the invention has been described in its preferred form with a certain degree of particularity, it will be understood that the present disclosure of the preferred embodiment has been made only by way of example and the various changes may be resorted to without departing from the true spirit and scope of the invention as hereinafter claimed. It is intended that the patent shall cover, by suitable expression of the appended claims, whatever features of patentable novelty exist in the invention disclosed.

What is claimed is:

1. In a gas injector having a porous ceramic body with a first surface through which gas can be introduced into the body, and a second surface spaced from the first surface, the second surface permitting gas to be discharged from the body, the improvement comprising:

a refractory member engaging the porous ceramic body and surrounding the first surface, the refractory member being substantially impervious to gas and having a coefficient of thermal expansion approximating that of the porous ceramic body.

2. The apparatus of claim 1, wherein the refractory member completely surrounds the porous ceramic body, except for the second surface.

3. The apparatus of claim 1, wherein the refractory member surrounds the first surface and a portion of the remainder of the porous ceramic body except for the second surface.

4. The apparatus of claim 1, further comprising a refractory sealant joining the refractory member to the porous ceramic body.

5. The apparatus of claim 1, wherein the refractory member is made predominately of graphite.

6. The apparatus of claim 1, wherein the refractory member is made predominately of silicon carbide.

7. The apparatus of claim 1, further comprising means for conveying gas through the refractory member and into the porous ceramic body through the first surface.

8. The apparatus of claim 7, wherein the means for conveying gas includes a refractory conduit extending into the refractory member, the refractory conduit being substantially impervious to gas and having a coefficient of thermal expansion approximating that of the refractory member.

9. The apparatus of claim 8, further comprising a structural support for the conduit.

10. The apparatus of claim 8, wherein the refractory conduit is made predominately of silicon carbide.

11. The apparatus of claim 10, wherein the structural support is in the form of a metal tube within which the conduit is disposed, the metal tube extending partially within the refractory member and the conduit projecting from the end of the metal tube to project further into the refractory member than the tube.

12. The apparatus of claim 7, further comprising a refractory support within which the porous ceramic body and the refractory member are disposed, the refractory support having a first opening through which the second surface is exposed, and a second opening through which the means for conveying gas extends.

13. The apparatus of claim 12, wherein the refractory member includes a surface facing the first surface of the porous ceramic body, the respective surfaces being spaced from each other to define a plenum therebetween into which gas is conveyed.

14. The apparatus of claim 13, further comprising a refractory support within which the porous ceramic body and the refractory member are disposed, the refractory support having a first opening through which the second surface is exposed, and a second opening through which the means for conveying gas extends.

15. The apparatus of claim 13, wherein the refractory member completely surrounds the porous ceramic body except for the second surface.

16. The apparatus of claim 13, wherein the refractory member surrounds the first surface and a portion of the remainder of the porous ceramic body except for the second surface.

17. The apparatus of claim 13, wherein the refractory member includes a surface facing the first surface of the porous ceramic body, the respective surfaces being spaced from each other to define a plenum therebetween into which gas is conveyed.

18. The apparatus of claim 13, wherein the porous ceramic body is formed predominately of alumina.

19. The apparatus of claim 13, wherein the porous ceramic body is formed predominately of spinel.

20. The apparatus of claim 13, wherein the porous ceramic body is formed predominately of silicon carbide.

21. The apparatus of claim 13, wherein the refractory member is formed predominately of graphite.

22. The apparatus of claim 13, wherein the refractory member is formed predominately of silicon carbide.

23. The apparatus of claim 13, further comprising a refractory sealant joining the refractory member to the porous ceramic body.

24. The apparatus of claim 23, further comprising a structural support for the conduit.

25. The apparatus of claim 24, wherein the refractory support is formed predominately of spinel.

26. The apparatus of claim 13, wherein the means for conveying gas is in the form of a refractory conduit extending into the refractory member, the refractory conduit being substantially impervious to gas and having a coefficient of thermal expansion approximating that of the refractory member.

27. The apparatus of claim 26, wherein the structural support is in the form of the metal tube within which the conduit is disposed, the metal tube extending partially into the refractory member and the conduit projecting from the end of the metal tube so as to project further into the refractory member than the tube.

28. The apparatus of claim 26, wherein the refractory conduit is made predominately of silicon carbide.

29. Gas injection apparatus, comprising:

a porous ceramic body having a first surface through which gas can be introduced through the porous ceramic body, and a second surface spaced from the first surface, the second surface permitting gas to be discharged from the porous ceramic body;

a refractory member engaging the porous ceramic body and surrounding the first surface, the refractory member being substantially impervious to gas and having a coefficient of thermal expansion approximating that of the porous body; and means for conveying gas through the refractory member and into the porous ceramic body through the first surface.

* * * * *

UNITED STATES PATENT AND TRADEMARK OFFICE

CERTIFICATE OF CORRECTION

PATENT NO. : 4,973,433

DATED : November 27, 1990

INVENTOR(S) : Ronald E. Gilbert, Harvey Martin, George S. Mordue

It is certified that error appears in the above-identified patent and that said Letters Patent is hereby corrected as shown below:

On the title page:

[75] Inventors: Ronald E. Gilbert, Chardon; Harvey Martin, Solon; George S. Mordue, Ravenna; David V. Neff, Euclid, all of Ohio

Signed and Sealed this

Fifth Day of January, 1993

*Attest:*

DOUGLAS B. COMER

*Attesting Officer*

*Acting Commissioner of Patents and Trademarks*